United States Patent [19]

Kutzner et al.

[11] 4,076,231

[45] Feb. 28, 1978

[54] APPARATUS FOR TRIMMING SIGNATURES

[75] Inventors: Willi Albert Peter Kutzner; Georg Schneider, both of Wurzburg, Germany

[73] Assignee: Koenig & Bauer Aktiengesellschaft, Wurzburg, Germany

[21] Appl. No.: 746,049

[22] Filed: Nov. 30, 1976

[30] Foreign Application Priority Data

May 12, 1975 Germany ..... 2554662

[51] Int. Cl.[2] ..... B41F 13/56

[52] U.S. Cl. ..... 270/21; 83/88; 270/54

[58] Field of Search ..... 270/1–22, 270/54–56, 21; 83/86, 88; 101/117, 226–227

[56] References Cited

U.S. PATENT DOCUMENTS

| | | | |
|---|---|---|---|
| 3,884,102 | 5/1975 | Faltin | 83/88 |
| 3,948,504 | 4/1976 | Woessner | 270/21 |

*Primary Examiner*—Clifford D. Crowder
*Assistant Examiner*—A. Heinz
*Attorney, Agent, or Firm*—Jones, Tullar & Cooper

[57] ABSTRACT

An apparatus for use in trimming the edges of folded signatures produced in web-fed rotary printing presses is disclosed. The signatures, which may exit from the printing press folder in an overlapping array, are supported from below by a conveyor belt or belts and are held from above by coacting hold-down belts. The signatures so positioned are moved past rotating chipping or cutting tools which remove excess material from the edges of the signatures. Either one or two chipping or cutting tools can be used and the apparatus is capable of trimming without reducing the production speed of the press which may be in the range of 40,000 signatures/hour.

9 Claims, 6 Drawing Figures

APPARATUS FOR TRIMMING SIGNATURES

FIELD OF THE INVENTION

The present invention is directed generally to an apparatus for trimming the side edges of moving signatures. More particularly, the present invention is directed to such a trimming apparatus which may be positioned immediately after the folder of a web-fed rotary printing press. Most particularly, the trimmer in accordance with the present invention trims the edges of moving signatures which issue from the folder in an overlapped or scale-like array with the signatures being held firmly in place both above and below.

A generally horizontal table is provided with a bottom conveyor belt or belts which receive the signatures from the folder. A second or top conveyor is mounted above the first and the signatures pass between the two conveyors which coact to hold the signatures in place. One or more chipping or slicing tools are secured to the table and trim the edges of the signatures as they pass along the table and past the chipping or slicing tools.

DESCRIPTION OF THE PRIOR ART

Apparatus for trimming folded signatures generally are known in the prior art. By way of example, U.S. Pat. No. 3,165,954 to Huck describes such an apparatus, which is intended to be used to trim folded signatures on three sides. For this purpose rotary longitudinally cutting and cross-cutting knives are used. A disadvantage of a trimming apparatus of this kind, is that rotary shearing knives are used, and, as is well known, the service life of such knives is most limited. A further disadvantage of such trimming devices is that since each of the folded signatures is individually trimmed, a plurality of large and expensive conveyor cylinders must be used. This makes the apparatus large, complicated and heavy.

Apparatus for conveying folded signatures are generally known. German Patent Specification No. 1,227,031 describes such an apparatus useable for the conveyance of folded sheets in an overlapped scale-like formation. As an appropriate means for this purpose, it is proposed to use a belt drive with an upper or top belt and a bottom belt.

SUMMARY OF THE INVENTION

It is an object of the present invention to provide an apparatus for trimming the side edges of signatures which are conveyed out of a folder in an overlapped scale-like formation.

The advantages derived from the invention are particularly that for the production of periodicals and magazines, folders may be used which deliver the folded pieces such as signatures by means of pins, and these are less expensive than folders equipped with grippers. The apparatus in accordance with the present invention permits trimming the signatures, conveyed out of the folder in an overlapped scale-like formation, on their sides parallel to the direction of conveyance, without the necessity of reducing the production speed (for example 40,000 signatures/hour) of the web-fed rotary printing press. The combination of an apparatus in accordance with the present invention and a folder, which first cross-folds and then folds longitudinally the strips which have been slit on the folder and are collated overlaying one another, makes possible the production of magazines. Furthermore since the apparatus is capable of being quickly switched over from "trimming" to "conveyance only" and vice versa, the usefulness of the web-fed rotary printing press is raised, because, for example, a web-fed rotary printing press designed for newspaper production, if combined with a folder which first cross-folds and then folds longitudinally, and which is capable of being switched off, may be quickly and simply switched over for magazine printing.

BRIEF DESCRIPTION OF THE DRAWINGS

While the novel features of the present invention are set forth with particularity in the appended claims, a full and complete understanding of the apparatus and its use may be had by referring to the following description of a preferred embodiment and as shown in the included drawings in which:

DESCRIPTION OF A PREFERRED EMBODIMENT

Figure 1:
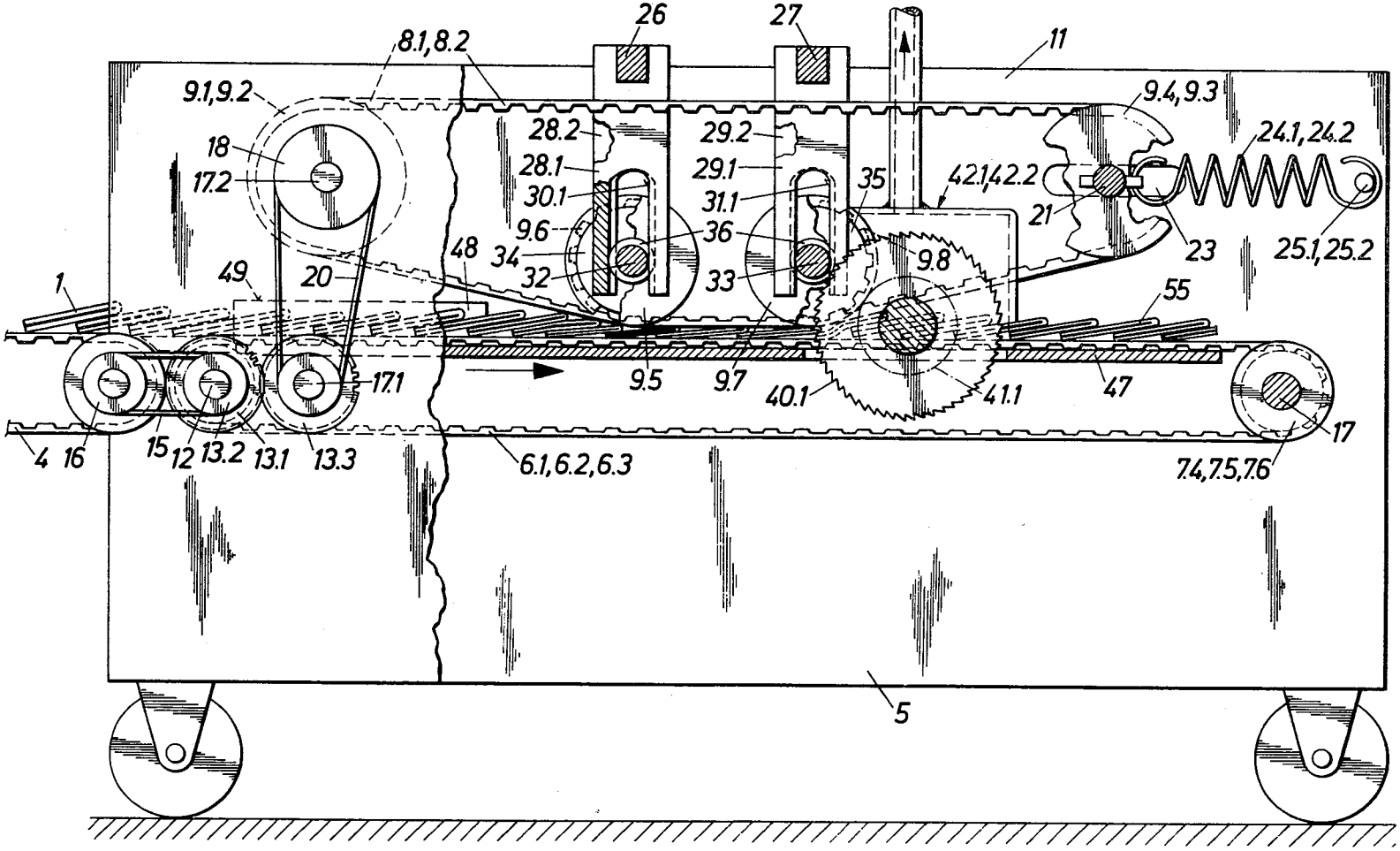
FIG. 1 is a side elevation view, partly in cross section, of the signature trimming apparatus in accordance with the present invention, taken along line I—I of FIG. 2.
Figure 5:
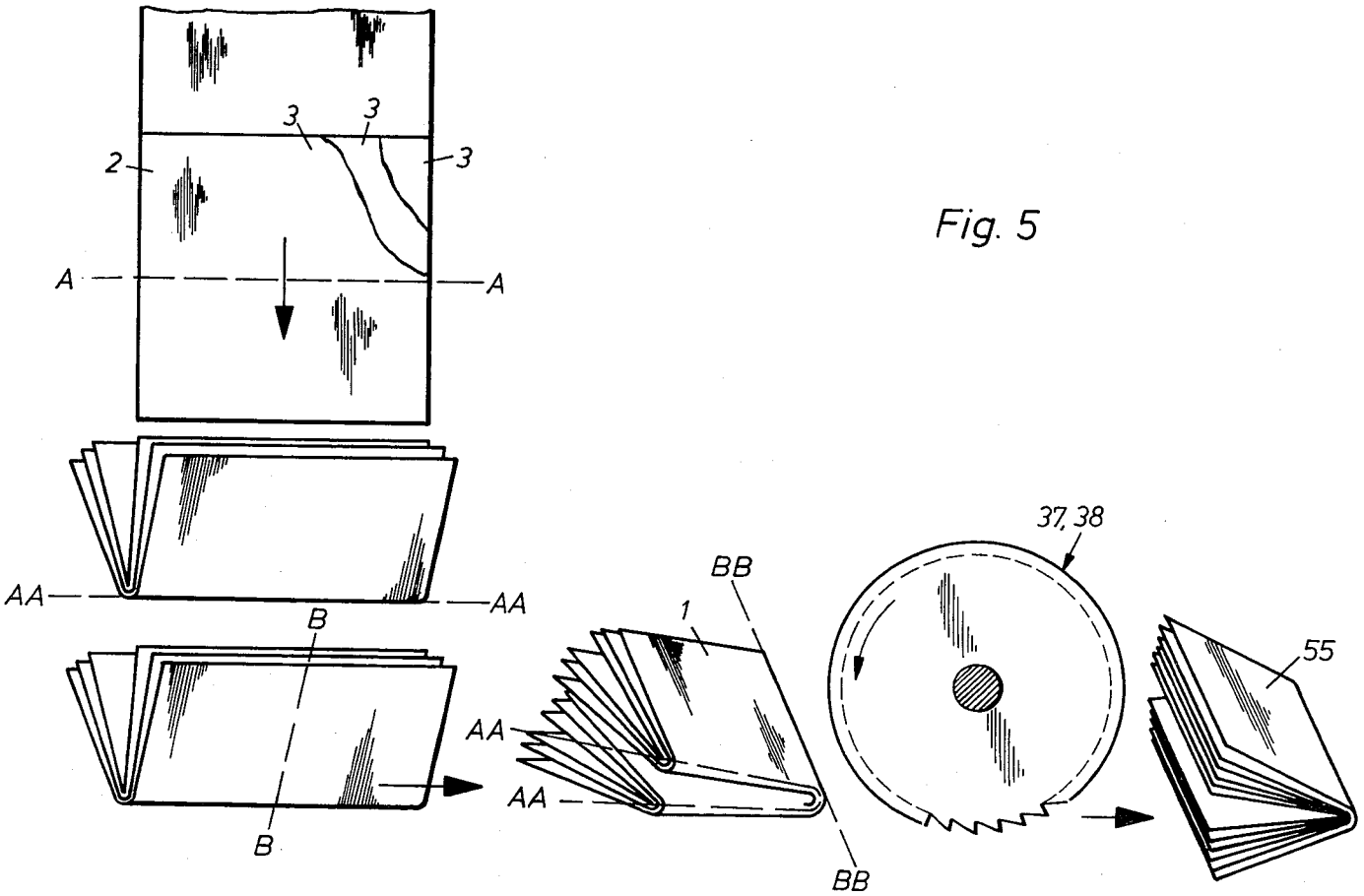
FIG. 5 is a schematic showing the productive steps of magazine production.

Turning now to FIG. 1 there are shown a plurality of folded signatures 1 produced by a known folder (not shown) and deposited on a conveyor belt 4. As is seen in FIG. 5, a strip comprising a plurality of collated ribbons overlying one another is cross-cut in the folder to form a section 2 comprised of a plurality of sheets 3. These sections 2 are folded by a folding cylinder (not shown) first along the line A — A (first cross fold), and then along the line B — B (second longitudinal fold, or so-called third fold respectively). By this procedure, a signature 1 is produced, the sheets of which cannot be turned because the signature 1 has not been cut along the folded edge AA—AA.

Referring again to FIG. 1, the conveyor belt 4, driven by the folder, transports the signatures 1 in an overlapped, scale-like formation out of the folder and conveys them in the overlapped, scale-like formation to a trimming apparatus 5 joined to the conveyor belt 4. As may be seen in FIGS. 1 and 2, three narrow horizontal bottom belts 6.1, 6.2, 6.3, or one broad conveyor belt are provided, with these narrow bottom belts being preferably endless toothed belts driven by three spaced, narrow gears 7.1, 7.2, and 7.3. It will be realized that, if space restrictions require it, the conveyor belt 4 may be integral with the narrow bottom belts 6.1, 6.2, 6.3 of the trimming apparatus 5. In this case the fan wheels of the folder deposit the signatures 1 directly on the narrow, slip-free driven bottom belts 6.1, 6.2, 6.3 which are located parallel to one another.

The gears 7.1, 7.2, and 7.3 are attached to a shaft 12 which is rotatably supported on side frames 10 and 11, with the gears being axially shiftable. Gears 13.1, 13.2 and 14 are secured on the ends of the shaft 12. The gear 13.2 is connected, as may be seen in FIG. 1, by means of a toothed belt 15 to a gear 16 rotating synchronously with the conveyor belt 4 of the folder delivery. The toothed bottom belts 6.1, 6.2, and 6.3 mesh with, in addition to gears 7.1, or 7.2, or 7.3, the teeth of 7.4, 7.5, or 7.6. Gears 7.4, 7.5, 7.6 are attached to a shaft 17 which is rotatably supported on the side frames 10 and 11, and these gears are capable of being axially shifted.

Figure 2:
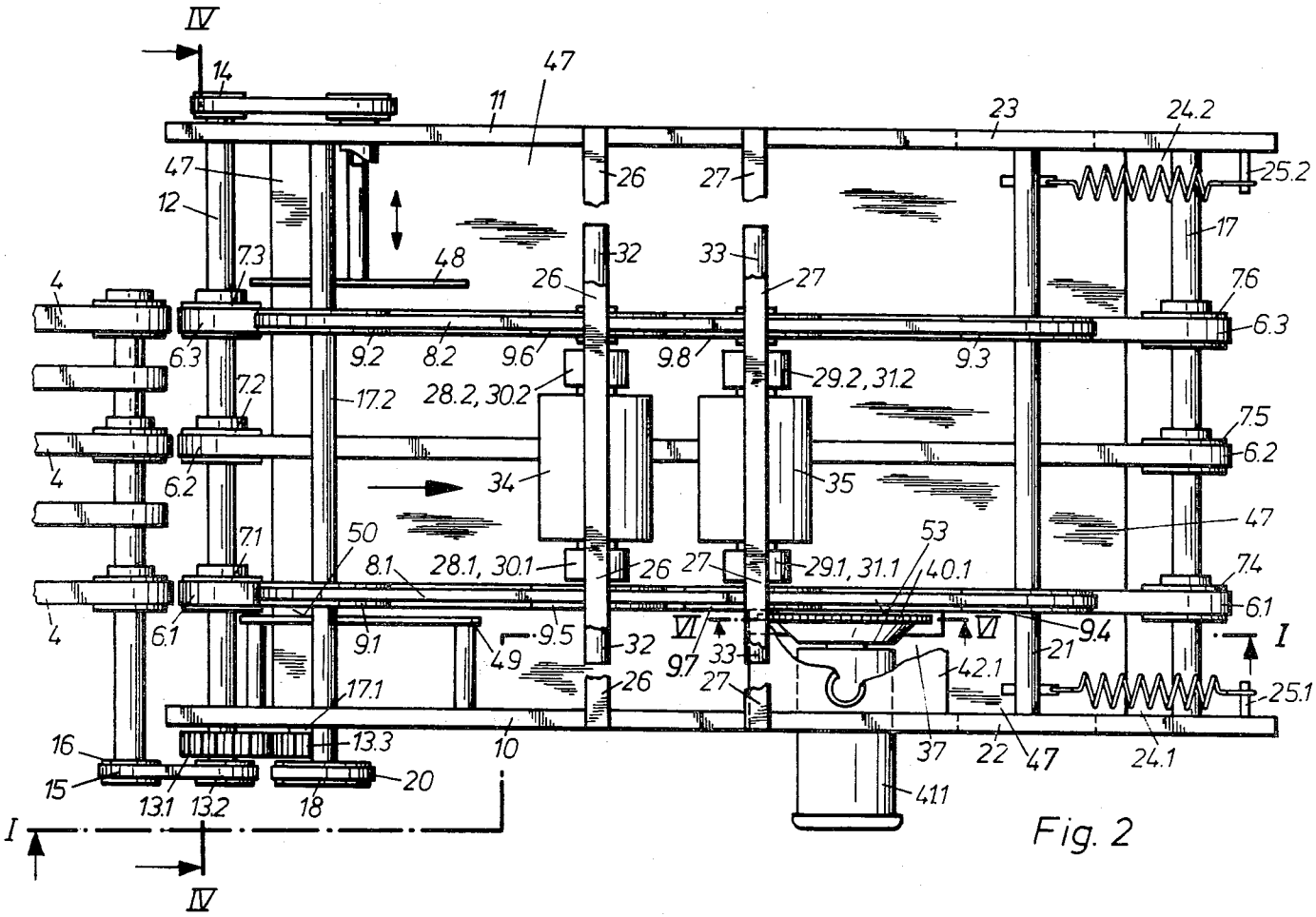
FIG. 2 is a top plan view of the apparatus in accordance with the present invention.

A pair of upper belts 8.1 and 8.2, as seen in FIGS. 1 and 2, are coordinated to the outer bottom belts 6.1 and 6.3. These top belts are also constructed as endless toothed belts and are positioned in such a manner that the untoothed outer sides of the bottom belts 6.1 and 6.3, and of the top belts 8.1 and 8.2 are located opposite to one another, to cover one another at least partially and preferably completely. A pair of gears 9.1, 9.2 are provided as a means for the slip-free drive of the upper belts 8.1, 8.2. The gears 9.1, 9.2 are attached to a shaft 17.2 which is rotatably supported on the side frames 10 and 11, and these gears are capable of being axially shifted. A gear 18 is secured on one end of the shaft 17.2. This gear 18 serves to drive the shaft 17.2 and is connected in power grip by means of a toothed belt 20 with one gear of the twin gear 13.3, while the other gear of the twin gear 13.3 meshes with the gear 13.1, as may be seen in FIG. 1. The twin gear 13.3 is supported on the axle 17.1 mounted on the side frame 10.

In addition to the teeth of the gears 9.1 and 9.2, the teeth of the upper belts 8.1 and 8.2 also mesh with the teeth of a plurality of gears 9.3 and 9.4, 9.5 and 9.6, and 9.7 and 9.8 respectively. The gears 9.3, 9.4 are rotatably supported on an axle 21 by conventional bearings, and are capable of being axially shifted. The axle 21 is disposed in horizontal guide slots 22, 23 which are provided in the side frames 10, 11, and axle 21 is capable of being horizontally shifted in reciprocating motion. Two draw springs 24.1 and 24.2 are attached at a first end to bolts 25.1 and 25.2 screwed to the side frames 10, 11 and, at a second end, to the axle 21. Thus it is possible to maintain continuous tension of the upper belts 8.1, 8.2.

Figure 4:
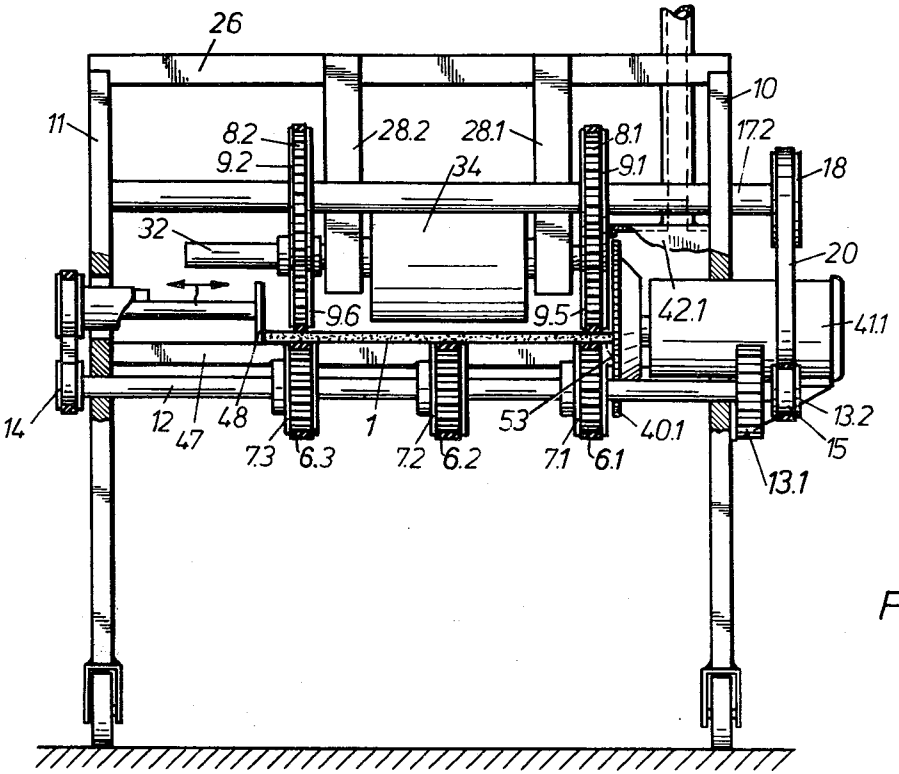
FIG. 4 is an elevation view of the apparatus in accordance with the present invention, taken along line IV—IV of FIG. 2.

Two pairs of forked members 28.1, 28.2, and 29.1, 29.2 extend vertically downwards from transverse members 26, 27 which are secured to the side frames 10 and 11, as may be seen in FIGS. 1 and 4. Each of the forked members 28.1, 28.2, 29.1, and 29.2 is equipped with a vertical guide slot 30.1, 30.2, 31.1, and 31.2, respectively. Four gears 9.5, 9.6, 9.7, and 9.8 are pressed into engagement with the teeth of the upper belts 8.1, 8.2 which drive them, as is seen in FIGS. 1 and 2. For this purpose a pair of ballast cylinders 34, 35, which are secured to the cross shafts 32, 33, are used. These ballast cylinders 34, 35 are preferably made of heavy metal or the like, and their outside diameters are substantially smaller than the dedendum circle diameters of the gears 9.5 to 9.8, so that they do not contact the signatures 1 conveyed under them. This arrangement may be seen most clearly in FIG. 4.

The gears 9.5, 9.6 are attached to the shaft 32, and the gears 9.7, 9.8 are attached to the shaft 33 so as to be capable of being axially shifted. The ends of the shafts 32, 33 are equipped with bearings 36, and these bearings are guided in their individual guide slots 30.1, 30.2, 31.1, and 31.2, respectively. These guide slots 30.1, 30.2, 31.1, and 31.2, allow the ends of the shafts 32, 33 and thus the gears 9.5 to 9.8 to move in the vertical direction if the thickness of the signatures varies or the overlapping of the scale of signatures is altered.

Figure 3:
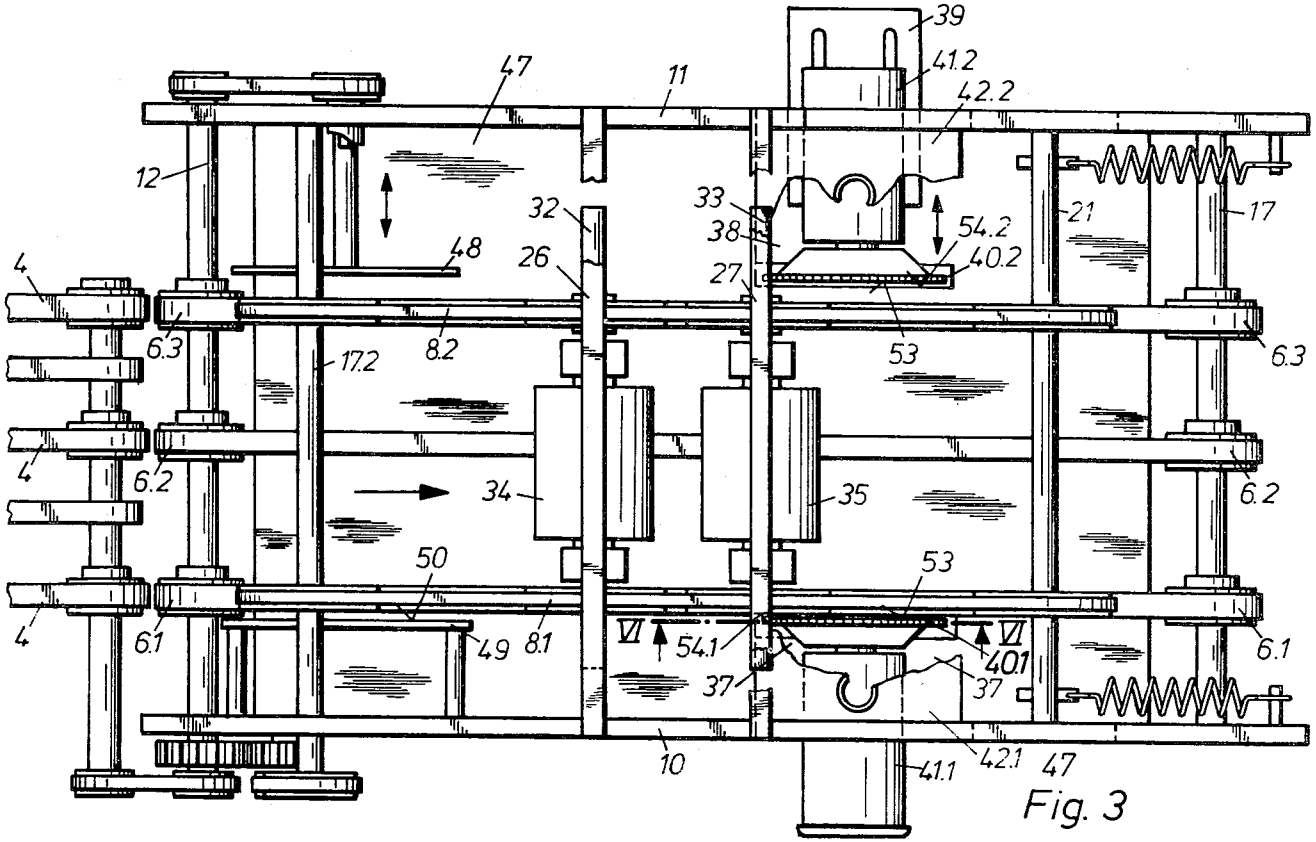
FIG. 3 is a top plan view similar to FIG. 2, and showing a second chipping tool.
Figure 6:
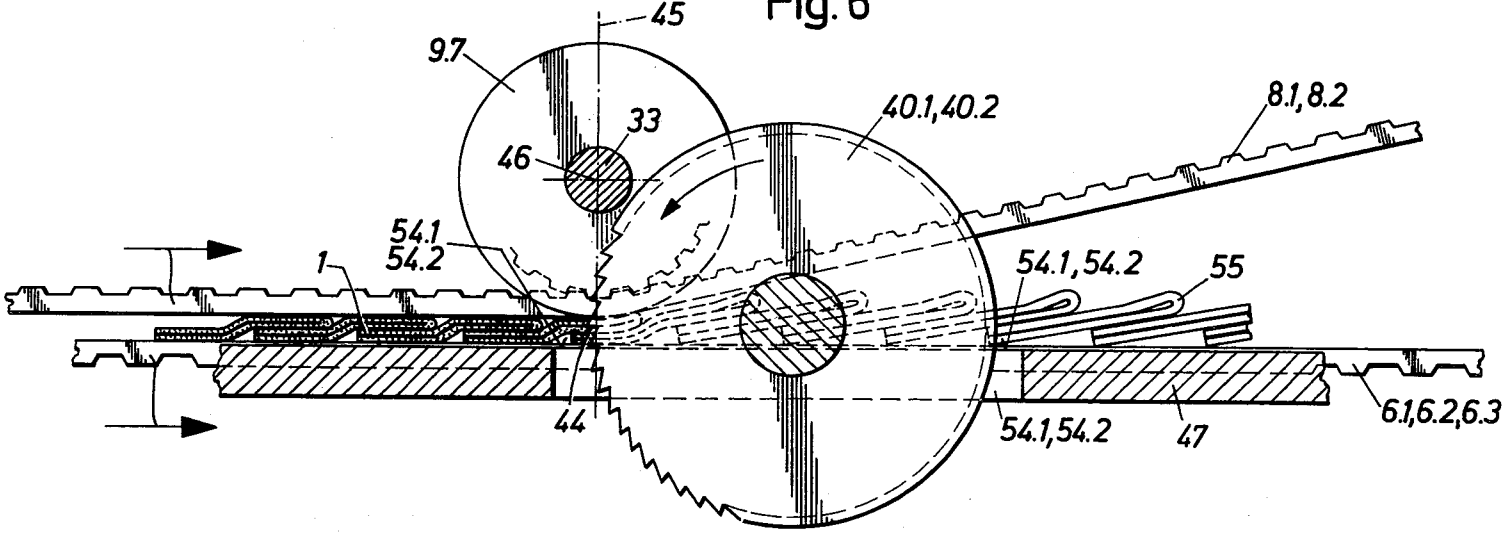
FIG. 6 is a side elevation view, partly in cross section, of the apparatus in accordance with the present invention taken along line VI—VI of FIG. 2 and showing the coaction of the chipping tool with the upper and lower belts.

On the right and/or on the left, in the direction of the conveying motion of the bottom belts, and outside of the bottom belts 6.1 or 6.3, trimming apparatus 37 or 38 for chipping paper are mounted on the side frames 10 and/or 11, respectively, as seen in FIGS. 1–3. Each trimming apparatus comprises mainly a rotary chipping tool 40.1 or 40.2, which may be, for example, a disk saw or a milling disk cutter, driven by a motor 41.1 or 41.2 respectively. The motor 41.1 is mounted on the side frame 10, the motor 41.2 is mounted and is capable of being shifted on a bracket 39 secured to the side frame 11. The chipping tool 40.1 or 40.2 respectively is attached to the shaft end of the motor, and is secured against axial shifting. The motor 41.1 or 41.2 is shown by way of example as an electric motor but may be designed as a hydraulic or pneumatic motor as well. If a milling disk cutter is used as a chipping tool 40.1, 40.2, a width of the chipping surface of the milling disk cutter is chosen which is larger than the paper edge to be chipped. Thus no paper strips, but only paper "chips" are produced, which then may easily be carried away by means of a suction hood 42.1 or 42.2. The chipping tools 40.1, or 40.2 respectively may be hard alloy tools or ceramic tools. The cutting rate should be between 30 and 120 m/sec so that production of smooth cut edges is insured. The chipping point 44; i.e., the point in which the chipping tools 40.1, 40.2 partially chip the signature 1, should be within the range of ± 10mm of an imaginary vertical line 45 which passes through the center 46 of the gear 9.7 and intersects the bottom belt 6.1 at a right angle as may be seen in FIG. 6. The gear 9.7 is, in this case, always the gear which is positioned closest to the chipping tool, and the top belt 8.1, which is carried by gear 9.7, presses the signatures 1 against the bottom belt 6.1. A horizontal plate 47 is fastened between the side frames 10, 11 to form a counter pressure surface for the bottom belts 6.1 to 6.3. The plate 47 is apertured in such a manner that it may serve as a counter cutting blade 54.1 to 54.2, as seen in FIG. 6, for the chipping tools 40.1 or 40.2, and it reaches to within a distance of 0.1mm to the chipping tool.

For alignment of the streams of signatures, a known aligning device is provided. The aligning device comprises an adjustable guiding bar 49, as seen in FIGS. 2 and 3, which is capable of being adjusted in a horizontal direction parallel to an oscillating plate 48. Guiding bar 49 is adjustably mounted between the chipping tool 40.1 and the side frame 10 at the inner side of the side frame 10. By shifting the guiding bar in a horizontal direction, it is possible to adjust the width of the edge to be chipped as required. The oscillating plate 48 is located across plate 47 from bar 49 and reciprocates rhythmically parallel to the guiding bar 49 and above the plate 47. The drive of the oscillating plate 48 is preferably branched from the drive of the bottom belts. By means of the reciprocating oscillating plate 48, the signatures 1 are aligned at the guiding bar 49 where they are then conveyed to the chipping tool 40.1 or 40.2 respectively along the guiding surface portion 50 of the guiding bar 49 by means of the bottom belts 6.1 to 6.3 operating in union with the top belts 8.1, 8.2.

It is obvious that in accordance with the present invention, it is possible to provide a second chipping tool 40.2 operating parallel to the first chipping tool 40.1 and located opposite to this first chipping tool 40.1. This would allow for trimming both edges of the signatures 1 in one continuous pass.

In summary, a web-fed rotary printing press produces, for example in a folder, a stream of signatures 1 in an over-lapped, scale-like formation, with the signatures being twice cross-folded and being uncut, for example, at the folded edges AA — AA and BB — BB. The continuous stream of signatures 1 is conveyed by means of appropriate conveyor means 4 to an aligning device 48, 49, which aligns the signatures 1 with respect to the chipping tool or tools 40.1 or 40.2 so that the rotating tool is capable of acting to trim the edges of the signatures 1. The aligned signatures 1 are transported between the top belts 8.1, 8.2, and the bottom belts 6.1, 6.2, 6.3, running over or respectively under one another, and these belts press the signatures 1 between them and convey them in the direction of the chipping tools 40.1, 40.2. In the course of this operation every pair comprising an upper belt coacting with a bottom belt is guided as close as possible to the surface 53 of the cutting tool 40.1, 40.2 which faces the signatures 1, in order to keep the signatures 1 pressed between the upper belt and the bottom belt during the chipping process. The rotary chipping tool, in cooperation with a counter cutting blade 54.1 or 54.2, separates or chips a strip of preadjusted width from the signature 1. If disk saws are used as the tools, strip-shaped scraps are produced, and if milling disk cutters are used, chip-shaped scraps are produced. If a strip is separated from the uncut signature 1 along the folded edge AA — AA, the product 55 is obtained as may be seen in FIG. 5. By means of the second chipping tool 40.2 it is possible to mill or to saw the edge of the signature which has the pin hole marks made by the conveyor while the first chipping tool 40.1 cuts along the folded edge AA — AA to form a product 55 having clean, even edges on both sides.

Thus it will be seen that there has been hereinabove fully and completely described an apparatus for trimming signatures in accordance with the present invention. It will, of course, be obvious to one of skill in the art that a number of changes in, for example, the number of conveying belts, the drive means for the conveying belts, the type of cutting tools, and the like could be made to the present invention without departing from the spirit and scope of the invention and that therefore this invention is to be limited only by the following claims.

We claim:

1. An apparatus for trimming at least a first edge from each one of a plurality of folded signatures while in an overlapped array, said folded signatures being produced in a web-fed rotary printing press, said apparatus comprising:

a generally planar support table, said table including at least one bottom conveyor belt and at least one top conveyor belt, said bottom and top belts receiving said folded signatures therebetween in said overlapped array from the press and carrying said signatures along said table;

means for causing downward pressure on said at least one top conveyor belt to press said overlapped array of signatures against said bottom conveyor belt; and at least a first rotating trimming tool carried on said table, said trimming tool contacting said first edge portion of each said signature to trim each said signature as said signatures are moved past said trimming tool in said overlapped array.

2. The apparatus of claim 1, wherein said trimming tool is a milling disk cutter.

3. The apparatus of claim 2 wherein said milling disk cutter has a cutting speed of between 30 and 120 m/sec.

4. The apparatus of claim 1 further wherein at least one ballast cylinder is said means for causing said pressure on said at least one top conveyor belt to press said top belt against said signatures.

5. The apparatus of claim 1 further wherein a second trimming tool is carried on said table, said second trimming tool being spaced from said first trimming tool and contacting a second edge of each said signature.

6. The apparatus of claim 1 wherein said trimming tool extends partially into an aperture in said table, an edge portion of said aperture forming a counter cutting blade.

7. The apparatus of claim 1, wherein said trimming tool is a saw disk.

8. The apparatus of claim 3 wherein said saw disk has a cutting speed of between 30 and 120 m/sec.

9. A method of trimming at least one edge portion of each one of an overlapped array of folded signatures produced in a web-fed rotary printing press, said method comprising:

receiving said overlapped array of folded signatures from said printing press on conveying means;

holding said overlapped array of folded signatures on said conveying means from above and below;

conveying said overlapped array of folded signatures past at least one rotating trimming wheel; and trimming said at least one edge portion of each of said folded signatures while said signatures are in said overlapped array, whereby each said signature is trimmed while in said overlapped array.

* * * * *

UNITED STATES PATENT AND TRADEMARK OFFICE

CERTIFICATE OF CORRECTION

PATENT NO. : 4,076,231

DATED : February 28, 1978

INVENTOR(S) : Willi Albert Peter Kutzner; Georg Schneider

It is certified that error appears in the above-identified patent and that said Letters Patent are hereby corrected as shown below:

IN THE CLAIMS

Claim 8, line 1, change "claim 3" to --claim 7--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*